United States Patent [19]

Teichmann et al.

[11] Patent Number: 4,662,766

[45] Date of Patent: May 5, 1987

[54] RIBBON FEED INCREMENT CHANGE MECHANISM AND CODED RIBBON CASSETTE TO ESTABLISH FEED INCREMENT

[75] Inventors: Friedrich Teichmann, Feucht; Karl Wenderoth, Bad Vilbel, both of Fed. Rep. of Germany

[73] Assignee: Triumph-Adler A.G., Nurnberg, Fed. Rep. of Germany

[21] Appl. No.: 348,091

[22] Filed: Feb. 11, 1982

[30] Foreign Application Priority Data

May 2, 1981 [DE] Fed. Rep. of Germany ... 8113008[U]
May 2, 1981 [DE] Fed. Rep. of Germany ... 8113009[U]

[51] Int. Cl.[4] ..... B41J 33/18; B41J 35/28

[52] U.S. Cl. ..... 400/208; 400/227.2; 400/236.1

[58] Field of Search ..... 400/207, 208, 208.1, 400/194, 195, 196, 196.1, 227.2, 236.1, 574.1, 575.1

[56] References Cited

U.S. PATENT DOCUMENTS

| | | | |
|---|---|---|---|
| 1,028,159 | 6/1912 | Utz | 400/474.1 |
| 2,062,455 | 12/1936 | Henry | 400/208 X |
| 2,161,856 | 6/1939 | Coxhead | 400/227.2 X |
| 3,346,090 | 10/1967 | Goff, Jr. et al. | 400/208 |

*Primary Examiner*—Charles A. Pearson
*Attorney, Agent, or Firm*—Joseph R. Spalla

[57] ABSTRACT

Mechanism for automatically adjusting the feed increment according to the type of ribbon in a ribbon cassette is characterized by a pawl and feed ratchet and to means operative by coded features on a cassette, when the cassette is mounted, to control the interval of engagement of the pawl and feed ratchet.

3 Claims, 2 Drawing Figures

Figure 1:
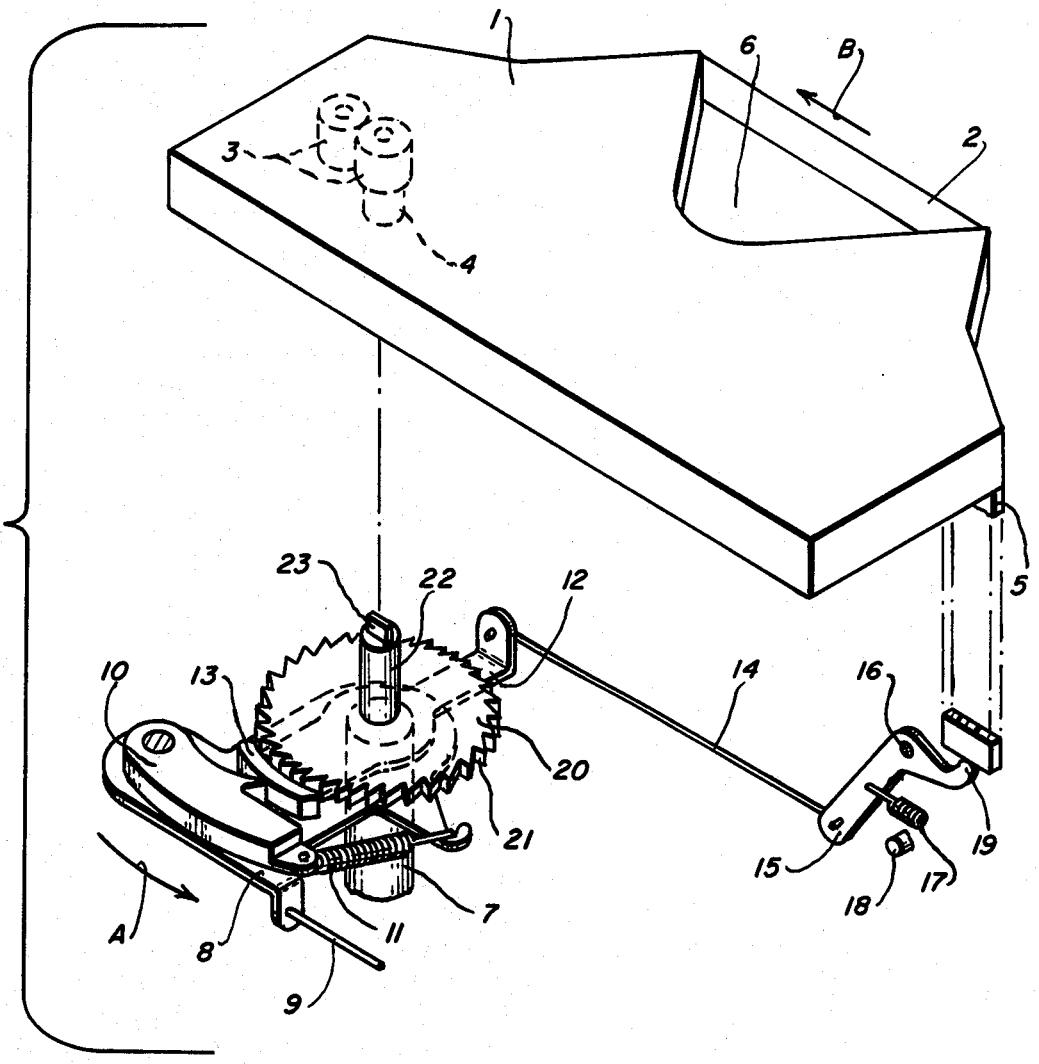

RIBBON FEED INCREMENT CHANGE MECHANISM AND CODED RIBBON CASSETTE TO ESTABLISH FEED INCREMENT

This invention relates to printer ribbon feed mechanism and to ribbon cassettes for conditioning the feed mechanism to incrementally feed ribbon according to the type of ribbon in the cassette; more particularly it relates to feed mechanism having a constant stroke pawl and feed ratchet drive and having means conditioned by a coded cassette for controlling the interval of engagement of the pawl and feed ratchet.

In the prior art there are disclosed, in U.S. Pat. Nos. 3,604,549 and 4,231,667, feed mechanisms for feeding different types of ribbon different feed increments in accordance with formations on the cassettes carrying the ribbon, which formations act to change transmission ratios in the feed mechanisms.

The prior art mechanisms as well as the cassettes designed therefore are complicated, expensive, and add mass to an assembly which is generally moved in printing direction with the printing element on a printing element carriage.

In accordance with the invention a feed mechanism characterized by an economy of parts in the form of a constant stroke pawl and a feed ratchet wheel is provided together with adjustable means to control the time of engagement of the pawl with the feed ratchet which is couplable to ribbon moving means in a mounted cassette. Also in accordance with the invention, the adjustable means is positioned according to coded features on the mounted cassette in the form of long or short projections depending externally of a cassette, allowing for a simple feed mechanism which can be driven as by a weak magnet.

An object of the invention is in the provision of a simple and economical ribbon feed increment change mechanism wherein the feed increment is established by a mounted ribbon cassette.

Another object of the invention is in the provision of a relatively low mass ribbon feed increment change mechanism requiring low power.

A further object of the invention is in the provision of a ribbon feed increment change mechanism wherein the feed increment is conditioned by coded features external to a ribbon cassette which can be easily accommodated in an injection mold.

Figure 2:
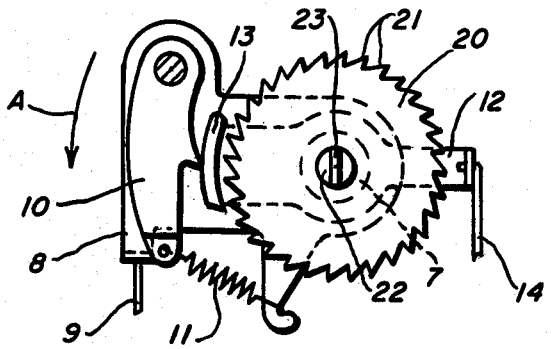

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is a perspective view of a ribbon cassette and ribbon feed mechanism for association with and controlled by the ribbon cassette in accordance with the invention; and FIG. 2 is a top elevational view of the ribbon feed mechanism shown in FIG. 1.

In its physical shape, the ribbon cassette 1 for the ribbon 2 may be adapted to the other subassemblies of the machine. In its interior, the cassette 1 has two transport wheels 3, between which the ribbon 2 can be clamped and transported. For this purpose, one of the transport wheels 3 has a coupling part 4 which can be coupled to the ribbon transport or feed mechanism. In addition, the ribbon cassette 1 has a depending projection 5 whose presence and length, or whose absence, determines the ribbon feed increment as will be described later. The type carrier of the typewriter is adapted to project into the free space 6 between the ribbon cassette 1 and the ribbon 2. The type carrier or print element (not shown) may be either of ball or disc shape.

The feed mechanism for the ribbon 2 consists of a shaft 7, to which is mounted a pivoting lever 8. Linked to the pivoting lever 8 is a pull rod 9 which interacts, for example, with a magnet, not shown. Pivoted on the pivoting lever 8 is a pawl 10, pulled in the direction towards the shaft 7 by a spring 11.

Mounted to the shaft 7 above the pivoting lever 8 is a control lever 12 which has an arcuate shield 13 which interacts with the pawl 10 in a manner yet to be described. Hooked to the control lever 12 is another pull rod 14 which is connected to an angular pivoting lever 15. The angular lever 15 can pivot about a fixed pin 16 and is acted upon by a spring 17. The latter tends to pull the angular pivoting lever 15 against a fixed stop 18. The other arm of the angular lever 15 is provided with a projection 19 located to interact with a projection 5 on a ribbon cassette 1.

Furthermore, a ratchet wheel 20 is mounted to the shaft 7 above the control lever 12. The teeth 21 of this ratchet wheel 20 are of saw tooth shape. Provided on the hub 22 of the ratchet wheel 20 is a coupling peg 23 which can be coupled to the coupling part 4 of one of the transport wheels 3 in the cassette.

As is evident from the drawing, the shield 13 is located between the pawl 10 and the teeth 21 of the ratchet wheel 20 in the normal unactuated position of the feed mechanism. It is also evident from the drawing that, depending on the angular position of the control lever 12 and hence, of the angular position of the arcuate shield 13, the pawl 10 will be allowed to engage the teeth 21 of the ratchet wheel 20 sooner or later incident to the pivoting of lever 8 in the direction of arrow A. In this process, the pawl 10 first slides over the shield 13 and then drops into the teeth 21 of the ratchet wheel 20 to turn it by a certain amount, also in arrow direction A. This rotary motion of the ratchet wheel 20 is transmitted to the transport wheels 3 via the coupling peg 23, whereby the ribbon 2 is transported by a corresponding amount in the direction of arrow B.

The position of the control lever 12 with the shield 13 relative to the normal position of the pawl 10 is determined by coded structure on the ribbon cassette 1 in the form of a projection 5 of a selected length or by the absence of a projection 5. If a cassette 1 does not have a projection 5, the angular lever 15 biased by spring 17 will not be moved away from the fixed stop 18 when the ribbon cassette 1 is mounted. The shield 13 on the control lever 12 will therefore remain in a maximum feed position corresponding to a long transport step for the ribbon 2 in the cassette. This means that when the pivoting lever 8 is moved in the direction of arrow A, the pawl 10 can slide off the sliding block 13 sooner and engage the teeth 21 of the ratchet wheel 20. Since the pivoting lever 8 always travels the same angular distance, a transport step for the ribbon 2 of an exactly predetermined length results.

If a projection 5 is provided on the ribbon cassette 1, it will push against the projection 19 of the angular lever 15 and pivot it an amount according to the length of the projection 5, countering the force of spring 17, when the cassette 1 is mounted. This causes the control lever 12 to pivot about its shaft 7, thereby moving the shield 13 a corresponding amount in the direction of arrow A. In consequence, the pawl 10 engages the teeth 21 of the ratchet wheel 20 later than before described upon a pivoting motion of the pivoting lever 8. Thus, a shorter feed increment is transmitted to the ribbon 2 by the transport wheels 3.

To prevent the ratchet wheel 20 from turning unintentionally in the opposite direction, i.e. opposite to arrow A, it may be provided with a so-called backlock or no back. This could be a free-wheeling clutch or a backlock or no back spring engaging the ratchet teeth 21.

Of course, it is also possible to design the length of the projection 5 so that any intermediate position for the shield 13 between maximum and minimum positions as described above is attainable according to the requirement of the ribbon type involved. In other words, the height or length of the projection 5 on the ribbon cassette 1 is coded according to the angular feed increment to be imparted to the ribbon 2.

As is evident from the foregoing, the invention allows in simple manner the manufacture of cassettes 1 whose projections 5 determine the length of the transport step for the ribbon 2. The projections 5 are expediently molded integrally with the cassette housing. They may, of course, also be designed as a supplemental component which can be clamped into the cassette by means of a simple plug connection.

As the drawing shows, an automatic shifting device for changing the feed increment of the ribbon 2 in a ribbon cassette 1 can be created by means of the invention in simple manner and without expensive components. In particular, no supplemental transmission components are required which idle along when a certain ribbon type is used, causing additional friction within the transmission.

In a modification of the embodiment shown, there may be provided instead of the coupling peg 23 on the ratchet wheel 20, a gear which can be caused to mesh with another gear mounted in the ribbon cassette 1. Then a ribbon windup spool, for example, may also be provided on the ribbon cassette gear shaft. Therefore, the innovation is applicable with the same advantage to different types of ribbon cassettes.

The invention claimed is:

1. The combination of feed mechanism for incrementally feeding printing ribbon according to ribbon type and cassettes for housing printing ribbons of different type adapted to be operatively mounted on said feed mechanism, said cassettes each having coded structure corresponding to the type of ribbon housed therein and said cassettes including means for moving ribbon past a printing point, said feed mechanism comprising drive means engageable with said ribbon moving means in said cassettes, said drive means including a shaft, a ratchet wheel mounted to said shaft and a lever pivotally supported on said shaft, said lever supporting a drive pawl and being operable in response to a print action to effect engagement of said supported pawl with said ratchet wheel, adjustable means for controlling the interval of engagement of said pawl and ratchet wheel, and means for adjusting said adjustable means according to the coded structure on the cassette operatively mounted on said feed mechanism.

2. The combination recited in claim 1, said means for adjusting said adjustable means comprising a pivotally mounted lever linked to said adjustable means, and a spring biasing said pivotally mounted lever whereby said adjustable means is adjusted to a maximum feed increment position, said pivotally mounted lever being movable against said biasing spring by the coded structure on the mounted cassette.

3. The combination as recited in claim 2, said adjustable means comprising a control lever rotatably mounted on said shaft mounting said ratchet wheel, and said control lever having an arcuate shield for holding said pawl out of engagement with said ratchet wheel according to the rotated position of said control lever.

* * * * *